US006607347B2

(12) United States Patent
Burgo

(10) Patent No.: US 6,607,347 B2
(45) Date of Patent: Aug. 19, 2003

(54) BACKHOE STABILIZING LEG

(75) Inventor: Giuseppe Burgo, Imola (IT)

(73) Assignee: New Holland North America, Inc., New Holland, PA (US)

( * ) Notice: Subject to any disclaimer, the term of this patent is extended or adjusted under 35 U.S.C. 154(b) by 0 days.

(21) Appl. No.: 09/732,463

(22) Filed: Dec. 7, 2000

(65) Prior Publication Data

US 2001/0010796 A1 Aug. 2, 2001

(30) Foreign Application Priority Data

Dec. 17, 1999 (IT) ..... BO99A0692

(51) Int. Cl.[7] ..... E02F 3/00

(52) U.S. Cl. ..... 414/680; 212/301; 414/685; 414/694

(58) Field of Search ..... 414/694, 685, 414/680; 280/766.1, 765.1; 212/301, 350; 37/345

(56) References Cited

U.S. PATENT DOCUMENTS 3,748,807 A * 7/1973 Sterner ..... 384/35
3,830,376 A * 8/1974 Fritsch ..... 212/350
4,478,014 A * 10/1984 Poock et al. ..... 212/350
4,759,452 A * 7/1988 Faint et al. ..... 212/350

FOREIGN PATENT DOCUMENTS

EP 0867566 A2 * 9/1998 ..... E02F/9/08

* cited by examiner

*Primary Examiner*—Eileen D. Lillis
*Assistant Examiner*—Michael Lowe
(74) *Attorney, Agent, or Firm*—John William Stader; Rebecca L. Henkel

(57) ABSTRACT

A stabilizing leg for a backhoe is formed with a tubular outer member, a stabilizer rod connected telescopically to the tubular outer member, and a clearance adjusting mechanism for adjusting the clearance between the tubular outer member and the stabilizer rod. The clearance adjusting mechanism is provided with at least one adjusting pad fitted to the tubular outer member so as to rest on an edge between two contiguous outer lateral surfaces of the stabilizer rod.

4 Claims, 3 Drawing Sheets

BACKHOE STABILIZING LEG

BACKGROUND OF THE INVENTION

The present invention relates to backhoes and, more particularly to a stabilizing leg for excavators equipped with an articulated swing arm fitted movably to the rear of the vehicle; to which application the following description refers purely by way of example.

As is known, some currently marketed excavators comprise an articulated swing arm fitted movably to a supporting frame fixed to the rear of the vehicle.

The supporting frame is normally horizontal and perpendicular to the longitudinal axis of the vehicle, and is provided at the ends with two stabilizing legs, which are set selectively on the ground underneath to prevent any undesired movement of the vehicle when operating the arm.

The two stabilizing legs are set perpendicular to the ground underneath, and currently comprise a tubular, rectangular-section outer member rigidly integral with the supporting frame of the articulated swing arm; a rectangular-section stabilizer rod connected telescopically to the tubular outer member; and a hydraulic jack for selectively moving the stabilizer rod axially between a withdrawn position almost entirely housed inside the tubular outer member, and an extracted position in which the bottom end of the stabilizer rod rests on the ground underneath.

The two stabilizing legs also comprise means for adjusting the clearance between the tubular outer member and the stabilizer rod.

Currently known clearance adjusting means are defined by two adjusting pads fitted through two contiguous lateral walls of the tubular outer member so that one end of each rests on a respective outer lateral surface of the stabilizer rod.

More specifically, the two adjusting pads are positioned resting on two perpendicular outer lateral surfaces of the stabilizer rod, and are each defined by a member made of self-lubricating material and fitted inside a corresponding through hole in the lateral wall of the tubular outer member. More specifically, each member has a flat surface which rests on the outer lateral surface of the stabilizer rod in such a way as not to prevent the stabilizer rod from sliding inside the tubular outer member.

A major drawback of currently known stabilizing legs lies in the clearance adjusting means, which are not very practical or accurate, and fail to provide for fast precise adjustment of the clearance between each outer lateral surface of the stabilizer rod and the corresponding inner lateral surface of the tubular outer member. Adjustment in fact is made by moving both adjusting pads back or forth with no certainty as to how far the ends of the two pads project inside the tubular outer member.

SUMMARY OF THE INVENTION

It is an object of the present invention to provide a stabilizing leg for a backhoe that overcomes the aforementioned disadvantages of the prior art.

According to the present invention, there is provided a stabilizing leg for work vehicles, the stabilizing leg comprising a tubular outer member; a stabilizer rod connected telescopically to said tubular outer member; and clearance adjusting means for adjusting the clearance between said tubular outer member and said stabilizer rod; said stabilizing leg being characterized in that said clearance adjusting means comprise at least one adjusting pad fitted to the tubular outer member so as to rest on an edge between two contiguous outer lateral surfaces of said stabilizer rod.

These and other objects, features and advantages are accomplished according to the instant invention by providing a stabilizing leg for a backhoe is formed with a tubular outer member, a stabilizer rod connected telescopically to the tubular outer member, and a clearance adjusting mechanism for adjusting the clearance between the tubular outer member and the stabilizer rod. The clearance adjusting mechanism is provided with at least one adjusting pad fitted to the tubular outer member so as to rest on an edge between two contiguous outer lateral surfaces of the stabilizer rod.

BRIEF DESCRIPTION OF THE DRAWINGS

The advantages of this invention will become apparent upon consideration of the following detailed disclosure of the invention, especially when taken in conjunction with the accompanying drawings, wherein.

DETAILED DESCRIPTION OF THE PREFERRED EMBODIMENTS

Figure 1:
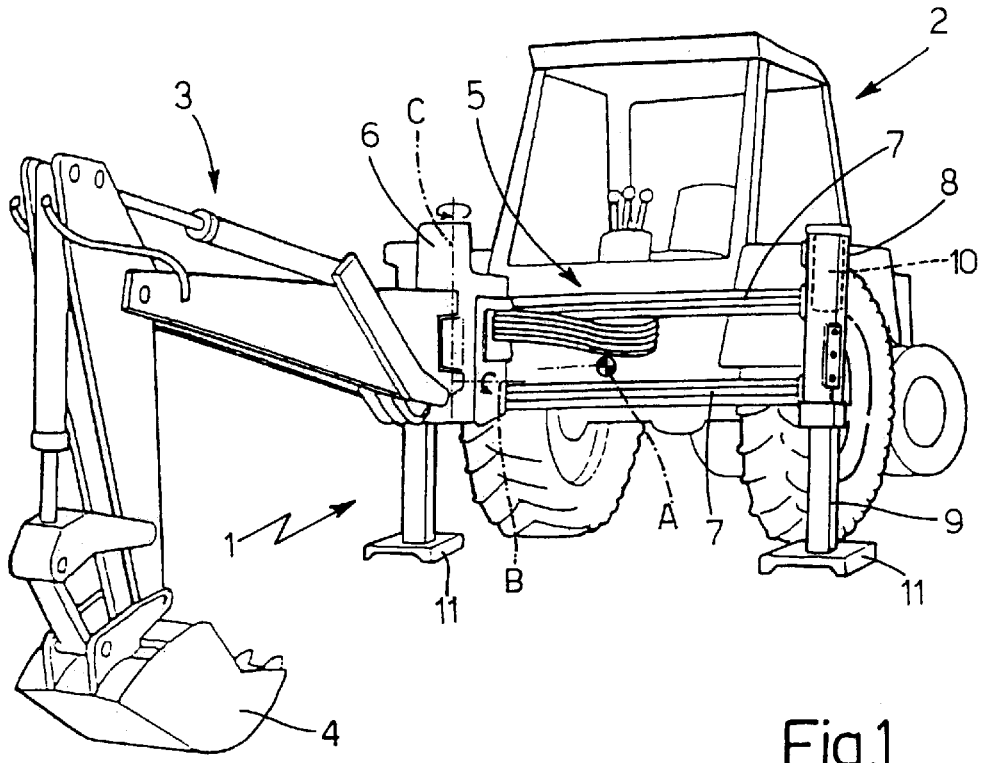
FIG. 1 is a rear perspective view a work vehicle, commonly referred to as a backhoe, incorporating two opposing stabilizing legs incorporating the principles of the present invention.

Referring first to the perspective view of FIG. 1, a work vehicle 2, commonly referred to as a backhoe, incorporating the principles of the instant invention can best be seen. The backhoe 2 is provided with a conventional articulated boom or swing arm 3 fitted on the end thereof with a bucket 4. The boom 3 is pivotally mounted to a supporting frame 5 fixed to the rear of the vehicle 2 for movement from side to side as is known in the art. The backhoe 2 is also provided with a pair of opposing stabilizing legs 1 mounted to the rear of the backhoe 2 to stabilize the backhoe 2 during normal working operation thereof where the boom 3 is used to dig into the earth immediately rearwardly of the vehicle 1.

In the example shown, the supporting frame 5 of the excavator 2 extends horizontally in a vertical plane perpendicular to the longitudinal axis A of the vehicle, and is formed as a supporting plate (not shown) integral with the vehicle frame, two horizontal guides 7 fixed one over the other to the supporting plate, and an arm slide 6 mounted to slide along the horizontal guides 7. The articulated boom 3 is hinged in known manner to arm slide 6 so as to rotate about two axes of rotation B and C, one horizontal and the other vertical, and both perpendicular to the longitudinal axis A of the vehicle.

With reference to FIG. 1, the two stabilizing legs 1 are located on opposite sides of the supporting frame 5, and each include a tubular outer member 8 fixed to the two horizontal guides 7 of the supporting frame 5 so as to be substantially perpendicular to the ground underneath, a stabilizer rod 9 connected telescopically to the tubular outer member 8, and a known hydraulic cylinder or jack 10 for selectively moving the stabilizer rod 9 axially between a withdrawn position, in which the rod 9 is almost entirely housed inside the tubular outer member 8, and an extracted position, in which the bottom end of rod 9 rests on the ground underneath.

In the example shown, the tubular outer member 8 has a substantially rectangular section, and is fixed to the supporting frame 5 at the respective ends of the two horizontal guides 7; and the stabilizer rod 9 is defined by a substantially rectangular-section tubular member fitted on the bottom end with a known stabilizer plate 11.

In the example shown, the hydraulic jack 10 is housed inside the tubular outer member 8, directly over the stabilizer rod 9, with a first end integral with the body of the tubular outer member 8, and with a second end integral with the stabilizer rod 9, so as to move the rod 9 axially with respect to the tubular outer member 8 by varying its own axial length.

Figure 3:
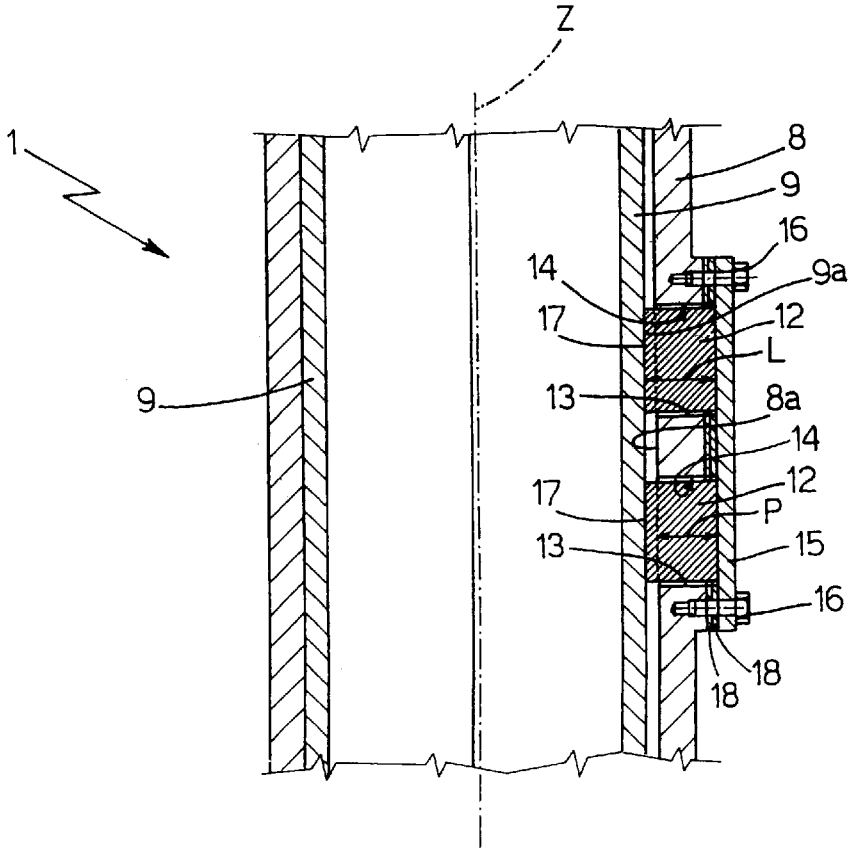
FIG. 3 is a cross-sectional view of the stabilizing leg shown in FIGS. 1 and 2, but taken orthogonally with respect to the view of FIG. 2.
Figure 2:
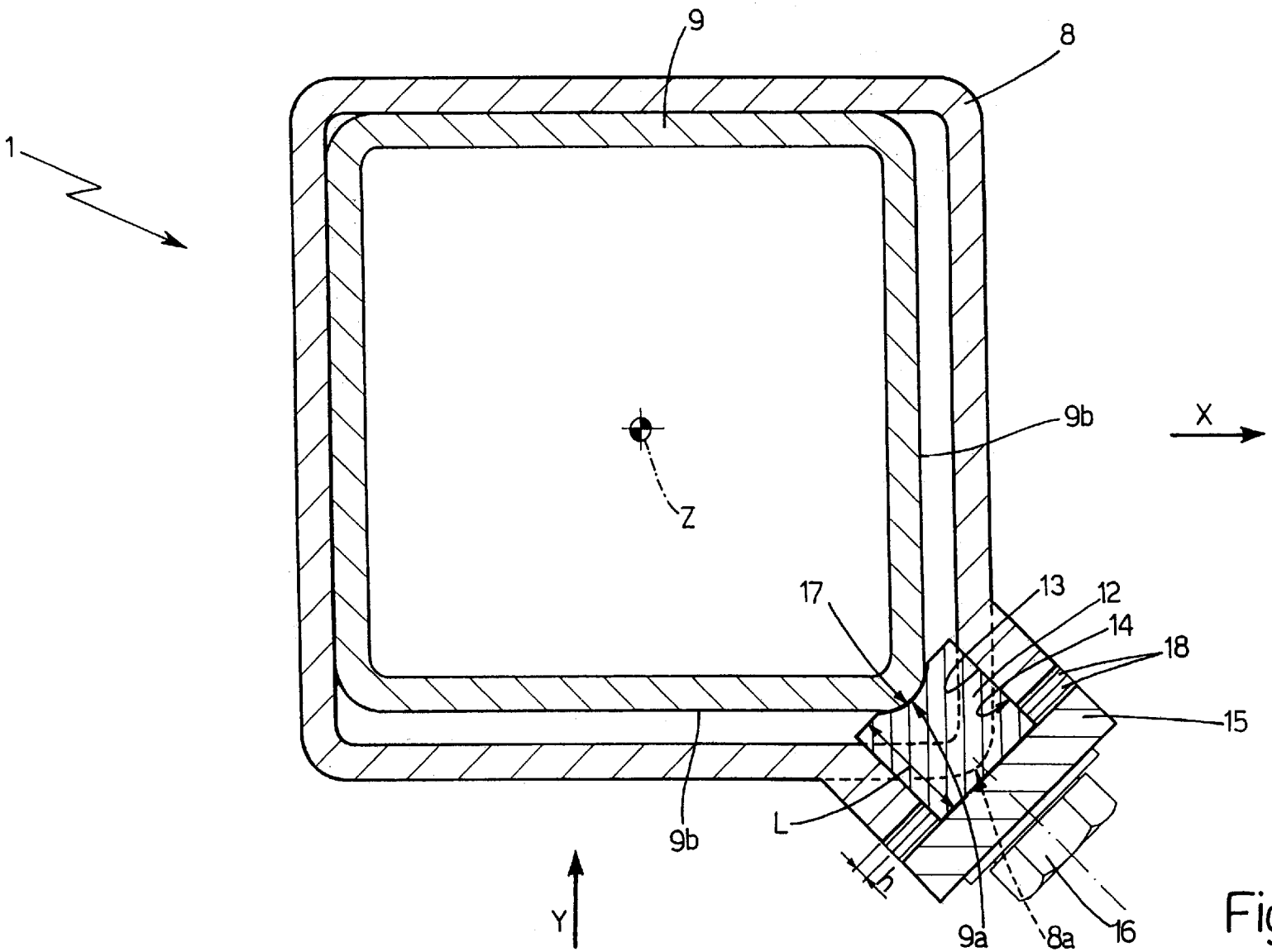
FIG. 2 is a cross-sectional view of one of the stabilizing legs depicted in FIG. 1.
Figure 4:
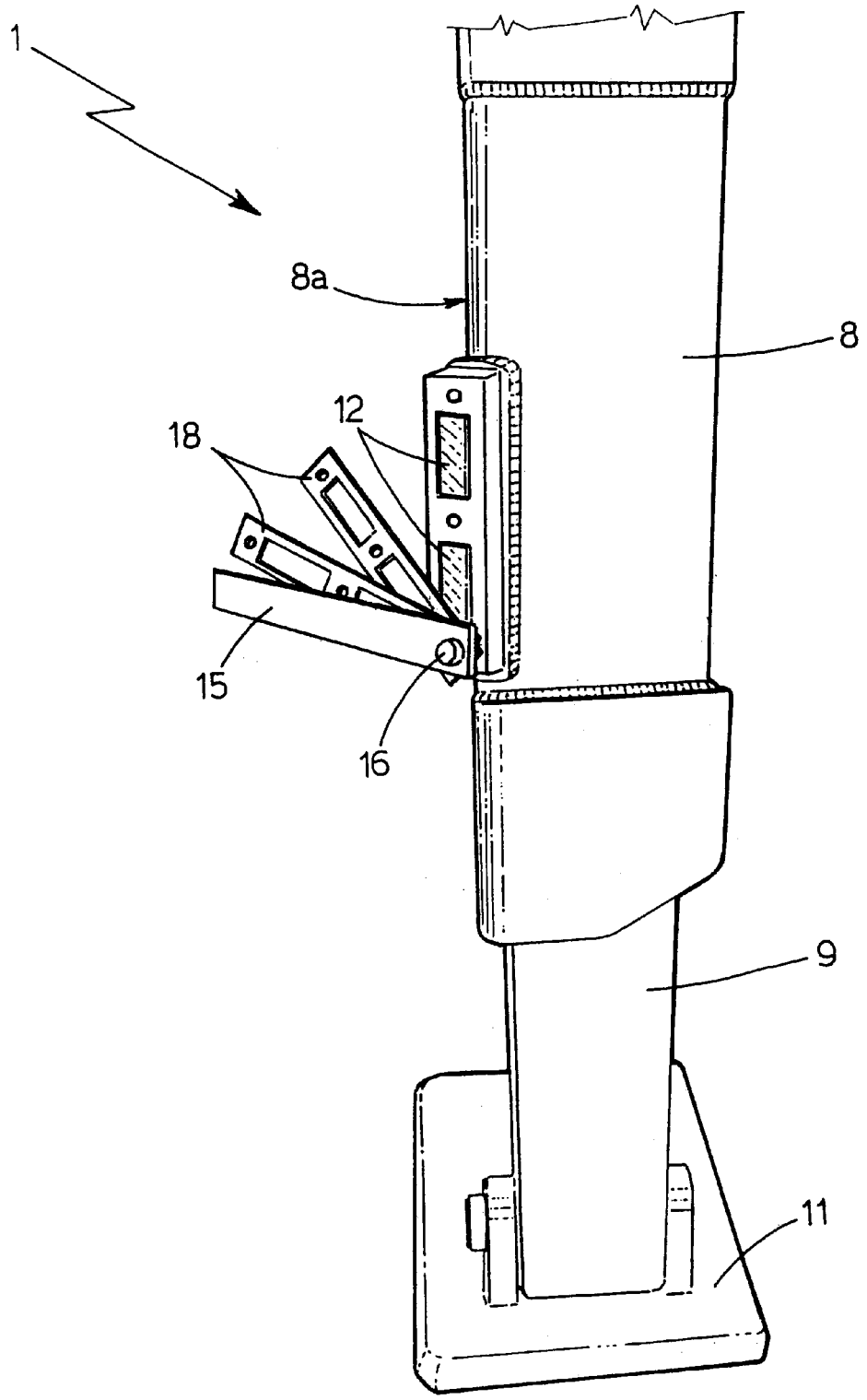
FIG. 4 is an enlarged perspective view of the stabilizing leg depicted in FIG. 1, with portions thereof being removed for purposes of clarity, to depict details thereof.

With reference to FIGS. 2, 3 and 4, the two stabilizing legs 1 are formed with an adjusting mechanism for adjusting the clearance between the tubular outer member 8 and the stabilizer rod 9. The stabilizing legs 1 are also provided with one or more adjusting pads 12 fitted to the tubular outer member 8 so as to rest on an edge 9*a* between the two contiguous outer lateral surfaces 9*b* of the stabilizer rod 9.

In the example shown, the adjusting means of each stabilizing leg 1 includes, depending on the number of adjusting pads 12, two of which are shown in the drawings, one or more pad seats 13 formed in the lateral wall of the tubular outer member 8, at an edge 8*a* of the tubular outer member 8 directly facing the edge 9*a* of the rod 9. Each pad seat 13 is adjustable in depth P and houses a respective pad 12 in axially-sliding manner so that the pad has two opposite axial ends resting on the bottom of the pad seat 13 and on the edge 9*a* of the stabilizer rod 9, respectively.

More specifically, each adjusting pad 12 is defined by a prismatic body of a given length L and preferably, though not necessarily, made of self-lubricating plastic material; and each pad seat 13 is defined by a rectangular-section through a hole 14 formed in the wall of the tubular outer member 8 at the edge 8*a,* and by an easily removable stop plate 15 closing through the hole 14 on the outside of the tubular outer member 8. In the embodiment shown, the stop plate 15 is fixed to the wall of the tubular outer member 8 by means of lock screws 16 screwed into the wall itself.

It should be pointed out that, in the embodiment shown, the axial end of the adjusting pad 12 resting on the edge 9*a* of the rod 9 has a groove 17 engaged in sliding manner by the edge 9*a.* More specifically, the groove 17 extends along the axial end of the pad in a direction parallel to the longitudinal axis Z of the tubular outer member 8, and has a profile complementary to that of the edge 9*a* of the stabilizer rod 9 so as to adhere perfectly to the outer lateral surface of the stabilizer rod 9.

As best seen in FIGS. 2, 3 and 4, the clearance adjusting means preferably includes one or more shims 18 which are interposed between the wall of the tubular outer member 8 and the stop plate 15 defining the bottom of the pad seat 13. The shims 18 are of a given height h and may be inserted in various numbers to adjust the overall depth P of each pad seat 13 as a function of the length L of the adjusting pad 12 housed inside the seat, or of the reduction in length L due to wear.

A primary advantage of the stabilizing legs 1 described above is that of greatly simplifying clearance adjustment and enabling one-point adjustment along axes x, y, as depicted in FIG. 2. In the proposed solution, in fact, the pad 12 is simply inserted inside through the hole 14, a predetermined number of shims 18 are inserted, and the stop plate 15 which closes through the hole 14 is then screwed to the wall of the tubular outer member 8.

Correct clearance adjustment is ensured by the pad 12 which is initially of a predetermined length L, and by the number of shims 18 inserted between the stop plate 15 and the wall of the tubular outer member 8.

At subsequent clearance adjustments, the number of shims 18 between the stop plate 15 and the wall of tubular outer member 8 is reduced to compensate for the reduction in length L of the adjusting pad 12 due to wear.

One skilled in the art will recognize another advantage of the stabilizing legs 1 in the simplifying of the design of the adjusting means and, thereby, greatly reducing the production cost of the stabilizing legs 1.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A stabilizing leg for work vehicles comprising:

a tubular outer member having four lateral generally continuous surfaces and a generally rectangular horizontal cross-section;

a stabilizer rod having four lateral generally continuous surfaces and a generally rectangular horizontal cross-section, said stabilizer rod fitting telescopically at least partially within said tubular outer member, said tubular outer member and said stabilizer rod each having four generally matching corners formed by contiguous surfaces, each corner comprising an edge;

a one, and only one, clearance adjusting mechanism for adjusting the clearance between said tubular outer member and said stabilizer rod, said clearance adjusting mechanism including:

an opening through one edge of said tubular outer member;

at least one pad seat formed in and through said one edge of said tubular outer member;

at least one elongate adjusting pad fitted to said pad seat and extending through said opening so as to rest on said one edge of said stabilizer rod between two contiguous lateral surfaces thereof; said pad having a longitudinal groove therein with a longitudinal profile complementary to that of said one edge;

said at least one pad seat is further fitted to said tubular outer member by a stop plate closing said opening on the outside of said tubular outer member, said stop plate defining a bottom portion of said pad seat, and being fixed to the wall of said tubular outer member by lock screws; and said at least one pad seat houses said adjusting pad in an axially-sliding manner so that two opposite axial ends of said adjusting pad rest against said stop plate and on the edge of said stabilizer rod, respectively, whereby tightening of said lock screws pushes said adjusting pad against said first edge of said stabilizer rod and push a second edge thereof, opposing said first edge, into contact with the inside corner of said tubular outer member opposite said through opening.

2. The stabilizing leg of claim 1 wherein said clearance adjusting mechanism includes at least one shim which is interposed between said stop plate and the wall of said tubular outer member to adjust the overall depth of said pad seat as a function of the length of the adjusting pad housed inside the pad seat.

3. In a backhoe having a mobile frame; and an articulated boom pivotally connected to a rearward portion of said backhoe to be movable about a generally vertical axis, and improved stabilizer leg comprising:

a tubular outer member having four lateral generally continuous surfaces and a generally rectangular horizontal cross-section;

a stabilizer rod having four lateral generally continuous surfaces and a generally rectangular horizontal cross-section, said stabilizer rod fitting telescopically at least partially within said tubular outer member, said tubular outer member and said stabilizer rod each having four generally matching corners formed by contiguous surfaces, each corner comprising an edge;

a one, and only one, clearance adjusting mechanism for adjusting the clearance between said tubular outer member and said stabilizer rod, said clearance adjusting mechanism including:

an opening through one edge of said tubular outer member;

at least one pad seat formed in and through said one edge of said tubular outer member;

at least one elongate adjusting pad fitted to said pad seat and extending through said opening so as to rest on said one edge of said stabilizer rod between two contiguous lateral surfaces thereof; said pad having a longitudinal groove therein with a longitudinal profile complementary to that of said one edge;

said at least one pad seat is further fitted to said tubular outer member by a stop plate dosing said opening on the outside of said tubular outer member, said stop plate defining a bottom portion of said pad seat, and being fixed to the wall of said tubular outer member by lock screws; and said at least one pad seat houses said adjusting pad in an axially-sliding manner so that two opposite axial ends of said adjusting pad rest against said stop plate and on the edge of said stabilizer rod, respectively, whereby tightening of said lock screws pushes said adjusting pad against said first edge of said stabilizer rod and push a second edge thereof, opposing said first edge, into contact with the inside corner of said tubular outer member opposite said through opening.

4. The backhoe of claim 3 wherein said clearance adjusting mechanism includes at least one shim which is interposed between said stop plate and the wall of said tubular outer member to adjust the overall depth of said pad seat as a function of the length of the adjusting pad housed inside the pad seat.

* * * * *